US010293567B2

(12) United States Patent
D'Amato

(10) Patent No.: US 10,293,567 B2
(45) Date of Patent: May 21, 2019

(54) METHOD OF PRODUCING A STACKING PROJECTION AND CORRESPONDING TOOL

(71) Applicant: SEDA INTERNATIONAL PACKAGING GROUP SPA, Naples (IT)

(72) Inventor: Gianfranco D'Amato, Arzano Naples (IT)

(73) Assignee: Seda International Packaging Group SpA, Arzano, Naples (IT)

( * ) Notice: Subject to any disclaimer, the term of this patent is extended or adjusted under 35 U.S.C. 154(b) by 507 days.

(21) Appl. No.: 14/771,607

(22) PCT Filed: Apr. 23, 2014

(86) PCT No.: PCT/EP2014/001085
§ 371 (c)(1),
(2) Date: Aug. 31, 2015

(87) PCT Pub. No.: WO2014/173538
PCT Pub. Date: Oct. 30, 2014

(65) Prior Publication Data

US 2016/0031178 A1 Feb. 4, 2016

(30) Foreign Application Priority Data

Apr. 25, 2013 (EP) ..... 13002192

(51) Int. Cl.
*B31B 50/00* (2017.01)
*B31B 50/74* (2017.01)
(Continued)

(52) U.S. Cl.
CPC ..... *B31B 50/00* (2017.08); *B31B 50/59* (2017.08); *B31B 50/74* (2017.08); *B31B 50/594* (2018.05);
(Continued)

(58) Field of Classification Search
CPC ..... B31B 43/00; B31B 50/00; B31B 50/59; B31B 50/74; B31B 2105/00;
(Continued)

(56) References Cited

U.S. PATENT DOCUMENTS 2,816,697 A 12/1957 Amberg
7,510,514 B2 * 3/2009 Messerschmid ..... B31F 1/0087 493/155
(Continued)

FOREIGN PATENT DOCUMENTS

CN 184710 A 10/2006
DE 102004056932 A1 5/2006
(Continued)

OTHER PUBLICATIONS

International Search Report for PCT/EP2014/001085 dated Aug. 13, 2014. 2 pages.
(Continued)

*Primary Examiner* — Sameh Tawfik
(74) *Attorney, Agent, or Firm* — Fish & Richardson P.C.

(57) ABSTRACT

In a method of producing a stacking projection and a corresponding tool a mandrel as part of the tool is inserted into a cup, wherein the mandrel comprises a receiving recess. The bottom part of the cup is then supported by a supporting tool and a collet is assigned to a region of the cup where the stacking projection is to be formed. Thereafter, at least a part of the collet is pressed radially inwardly in direction to the receiving recess such that a portion of the cup wall is pressed into the receiving recess to form the stacking projection. Simultaneously, the height of the cup is reduced by displacing the mandrel and/or the supporting tool with respect to the other in axial direction. Finally, pressure applied to the collet is released and the cup is removed with the mandrel from the collet and the supporting tool. By such
(Continued)

method and corresponding tool the stretching of the wall material is avoided as well as any defect of an inner layer of polymer of this material and simultaneously the method of production and corresponding tool are simplified or of simply construction and can be used for high production rates of corresponding cups.

13 Claims, 4 Drawing Sheets

(51) Int. Cl.
*B31B 50/59* (2017.01)
*B31B 50/81* (2017.01)
*B31B 105/00* (2017.01)
*B31B 120/00* (2017.01)

(52) U.S. Cl.
CPC ..... *B31B 50/81* (2017.08); *B31B 2105/00* (2017.08); *B31B 2105/0022* (2017.08); *B31B 2120/002* (2017.08)

(58) Field of Classification Search
CPC ..... B31B 50/0014; B31B 2120/002; B31B 50/81; B31B 2105/0022
USPC ..... 493/152
See application file for complete search history.

(56) References Cited

U.S. PATENT DOCUMENTS 8,734,309 B2 * 5/2014 Johns ..... B31B 43/00 493/152
2006/0118608 A1 * 6/2006 Stahlecker ..... B31F 1/0038 229/403
2006/0144915 A1 * 7/2006 Sadlier ..... B65D 3/22 229/403
2006/0226210 A1 10/2006 Stahlecker
2007/0262129 A1 * 11/2007 Zadravetz ..... B31F 1/0038 229/403
2009/0020597 A1 * 1/2009 D'Amato ..... B65D 21/0233 229/403
2009/0184020 A1 7/2009 Messerschmid et al.
2010/0160130 A1 * 6/2010 Messerschmid ..... B31B 50/00 493/154
2011/0174656 A1 * 7/2011 D'Amato ..... B31F 1/0038 206/505
2014/0121087 A1 5/2014 Stahlecker et al.

FOREIGN PATENT DOCUMENTS

DE 102005017741 A1 10/2006
DE 10 2009 031691 A1 6/2010
DE 102011078363 A1 1/2013
EP 1785265 A1 5/2007
EP 1 990 184 A1 11/2008
EP 2522598 A1 11/2012
FR 1181342 A 6/1959
JP 55-134046 A 10/1980
JP 6-227564 A 8/1994
JP 2009-173346 A 8/2009
WO 2011124289 A1 10/2011

OTHER PUBLICATIONS

Notice of Opposition Proceedings filed Dec. 9, 2016 in counterpart European Patent No. 2 796 282 B1.
Office Action which dated Jan. 15, 2018 in corresponding Japanese Application No. 2016-509325.

* cited by examiner

METHOD OF PRODUCING A STACKING PROJECTION AND CORRESPONDING TOOL

CROSS REFERENCE TO RELATED APPLICATION

This is the U.S. National Phase Application under 35U.S.C. § 371of the International Patent Application No. PCT/EP2014/001085filed Apr. 23, 2014,which claims the benefit of European Patent Application No. 13002192.6filed Apr. 25, 2013,both of them are incorporated by reference herein. The International Application was published in English on Oct. 30, 2014as WO2014/173538 A1under PCT article 21(3).

FIELD OF THE DISCLOSURE

The application is directed to a method for producing a stacking projection inwardly protruding from a wall of a cup and also to corresponding tool.

BACKGROUND OF THE INVENTION

A corresponding cup is for example disclosed in EP 1 785 265 A1. This application also discloses a device for producing a stacking projection on a container wall. A corresponding device or tool comprises a mandrel and a support ring which is open at its top. The two parts are movable relative to one another between a stand-by position and a deformation position. The mandrel comprises a retaining indentation running externally circumferentially and the support ring comprises at least in some places a notch projection running internally circumferentially. By the interaction of the mandrel and the support ring in deformation position the stacking projection is produced.

Another stacking projection is for example disclosed in DE 10 2004 056 932 A1 or also in FR 1 181 342. However, corresponding references disclose a holding of a cup bottom between two tools and a radial pressing of a part of the cup wall in direction to the inner of the cup to form a corresponding stacking projection or ledge which is used as a supporting shoulder for a bottom edge or the like of second cup inserted in the first cup for stacking of the cups.

Any radial compression of a part of the wall of the cup will result in a stretching of the material. Such stretching may cause an inner layer of polymer applied to the paper material of the cup to thin out and sometimes make pinholes which may cause leaking. Moreover, any paper that is stretched looses some of its mechanical strength and becomes weaker.

BRIEF SUMMARY OF THE INVENTION

It is an object of the present invention to improve a method of producing the stacking projection and to provide a corresponding tool according to which such stretching of paper material is avoided as well as any defects of an inner layer of polymer of the paper material wherein simultaneously the method of production and corresponding tool are of simple construction and can be used for high production rates of corresponding cups with such stacking projections.

DETAILED DESCRIPTION OF THE INVENTION

According to a corresponding method for producing a stacking projection inwardly protruding from a wall of a cup the following steps are used.

The particular bottom part of the cup is supported by a supporting tool as part of the tool. Thereafter or also simultaneously with the support a collet is assigned to a region of the cup wall where a stacking projection is to be formed. A corresponding cup is then transported to the supporting tool and the collet by a mandrel which is inserted within the cup and which comprises a receiving recess which is at least open to an outer circumference of the mandrel. In such a way the cup and in particular its lower region is also inserted within the collet and is placed on the supporting tool. At the end, the collet is radially inwardly pressed in direction to the receiving recess such that a portion of the cup wall is pressed into the receiving recess to form the corresponding stacking projection. In particular to avoid any stretching of the paper as mentioned above, simultaneously to such pressing of the cup wall by the collet the height of the cup is reduced by displacing the bottom part of the cup in axial direction, which means a relative movement of and in particular by approaching the mandrel and the supporting tool. This means, there is a corresponding inward movement of the collet and simultaneously the mandrel and supporting ring approach each other to prevent any stretching of the paper material in particular in the area of the stacking projection. As such stretching is prevented according to the present application there is no stretching of the paper material, no stretching of inner layer of polymer of the paper material and there will also be no thinning out or pinholes causing leakage, see the comments set forth above.

Thereafter, the pressure applied to the collet is released and the cup is removed with the mandrel from the collet and the supporting tool.

According to a particular construction of the collet and to simplify the application of pressure in direction to the receiving recess the collet comprises a plurality of collet fingers at an upper end which will be radially inwardly pressed to press the paper material of the cup into the receiving recess. All of the collet fingers are separated from each other by a slot there between.

The corresponding collet can be made of steel or the like and may be relatively thin. To apply corresponding pressure to the collet fingers it is feasible that the collet with its collet fingers is axially displaced such that an outer surface of each collet finger slides along an inwardly and downwardly converging slide surface of a ring tool which surrounds at least the collet. By such movement of the collet fingers they are rotated or pivoted inwardly by a corresponding cam action between the outer surface of each collet finger and the slide surface of the ring tool. The ring tool can of course also surround the supporting tool and is another part of the tool for producing the stacking projection.

To axially displace the collet different possibilities are feasible. According to quite a simple possibility the collet is moved together with the supporting tool and the mandrel when those are axially displaced. This means, mandrel and supporting tool are moved together in axial direction and the collet is moved together with the mandrel and/or the supporting tool.

As the collet is made of a thin material it is possible that there is a particular rotation within the collet, which means that an upper part of the collet with the collet fingers is rotated or pivoted radially inward and a lower part of the collet is rotated or pivoted radially outward with respect to the supporting tool and the mandrel. This can be realized by supporting the collet and its collet fingers by an inner surface of the ring tool in a release position of the collet and then tilting the collet fingers radially inwardly and the lower part of the collet beneath the collet fingers radially outwardly to obtain such a rotating or pivoting movement of the collet. Also by this pivoting or tilting movement there is no mere radial pressure applied by the collet in direction to the receiving recess which will also reduce any stretching of the paper.

After the stacking projection is formed the cup will still be held on the mandrel and can be removed from the collet and the supporting ring with help of the mandrel. Of course, the cup will also be transported to the collet and the supporting tool by the mandrel. For holding the cup on the mandrel some low pressure might be used.

As already outlined above, the collet may be moved together with a supporting tool. This can in particular be done by an axial movement of the collet and fingers with respect to the ring tool by retraction of the supporting tool with respect to the ring tool in axial direction. This means, the collet is moved together with the supporting tool.

To use something like a die for pressing the cup wall into the receiving recess a step-like protrusion may be arranged on each collet finger. This step-like protrusion will be pressed into the receiving recess and the outer shape of the protrusion corresponds to the shape of the stacking protrusion to be formed in the cup wall. Moreover, such a step-like protrusion has a particular tip at an end of the corresponding protrusion which is used to form a ring-shaped embossment radially inwardly protruding from the cup wall into the receiving recess. There might already be a contact between this tip of the protrusion and the cup wall prior to applying pressure to move the collet fingers into the receiving recess. This means, by the corresponding protrusion this embossment is formed prior to pressing the cup wall into the receiving recess and this embossment will represent some initial step for forming the stacking projection and will represent a starting and weakening line for folding the cup wall to the inside of the cup by further pressing the collet fingers into the receiving recess.

According to a simple solution of the invention it might be possible, that due to pressing of the collet radially inwardly and the reduction of a height of the cup, the mandrel and the supporting tool are in a first distance to each other bigger than the thickness of the material of in particular a bottom plate of the cup arranged there between and to reduce the first distance during the corresponding pressing step by a certain amount which is sufficient to avoid any stretching of the paper during the forming of the stacking projection or corresponding ledge.

A corresponding reduction of distance may be 1 mm to 3 mm or 1.5 mm to 2.5 mm.

After the forming of the stacking projection the cup will be removed at least from the collet and from the supporting tool. The cup will still be held on the mandrel by corresponding low pressure. For maintaining the stacking projection and the corresponding form of the cup wall in this area it is further in general of advantage if for example for a double-wall cup an overwrap is then arranged outside of the cup and is glued onto the cup, wherein also other possibilities of fixing the overwrap to the cup are possible. To stabilize the stacking projection or ledge by such fixing of the overwrap onto the cup it is generally sufficient, if in particular at least in positions above and below the stacking projection such fixing is realized.

By such fixing also a corresponding compression of the cup according to the reduction of height will also be maintained.

The corresponding tool for forming such a stacking projection will at least comprise the mandrel to be inserted into the cup, said mandrel having the receiving recess, a supporting tool for supporting the bottom part of the cup, and a collet with a plurality of collet fingers. Those collet fingers are pivotable essentially radially inwardly in direction to the receiving recess and are pivotable between the release position and the pressing position. In the release position it is possible to arrange the cup on the supporting tool and within the collet by movement of the mandrel and in the pressing position corresponding collet fingers press into the receiving recess to form the corresponding stacking projection or ledge. Furthermore, in the release position prior to producing the stacking projection the distance between a lower end surface of the mandrel and an upper support surface of the supporting tool is bigger than in the pressing position. By this approaching of mandrel and supporting tool the corresponding compression of the cup is realized, see also our discussion set forth above. Such approaching of the mandrel and supporting tool results in a corresponding reduction of height of the cup in axial direction.

As already outlined the receiving recess of the mandrel is formed at a lower end of the mandrel and is at least opened to the outer circumference of the mandrel. According to the arrangement at the lower end it is also possible that the receiving recess is additionally open to the lower end surface of the mandrel.

To allow the application of low pressure and for holding the cup on the mandrel the mandrel may comprise a number of low pressure lines that end in an outer surface of the mandrel. Some of these low pressure lines may end in the lower end surface of the mandrel and other pressure lines may end in the circumferential surface and the cup may in particular be held onto the mandrel in areas also where the receiving recess is arranged.

This application of low pressure will result in a secure holding of the cup also during arranging of the overwrap and fixing same to the cup.

Generally, a corresponding bottom plate of a bottom part of a cup is flat such that it would be advantageous if the support tool also comprises an essentially flat upper surface for supporting such bottom plate of the cup. Generally, a cup has some bottom edge surrounding this bottom plate wherein the bottom edge is used for placing the cup onto some surface. To also arrange this bottom edge on or within the supporting tool it may additionally comprise a groove surrounding the support surface for receiving such bottom edge.

As corresponding cups have generally a circular cross section it is of further advantage when the collet is ring-shaped and surrounds the support tool. For movement of the collet together with the supporting tool, the collet is connected to the supporting tool and then may be moved together with any movement of the supporting tool in axial direction. The plurality of collet fingers are formed at an upper end portion of the collet. Corresponding lower end portion of the collet beneath the collet fingers may have a closed ring structure.

To slightly reduce the stiffness of the collet fingers, it might be recommendable that they are separated from each other by a slot and that each collet finger has a step-like protrusion extending in direction to the receiving recess. This step-like protrusion has a tip between a generally upwardly and inwardly converging surface and a flat upper surface. The outer shape of the stacking projection will have a similar form after forming same by pressing the collet fingers into the receiving recess.

It was already said that there is some cam action for pivoting the collet fingers into the receiving recess. This is possible according to outer surfaces of the collet fingers which are in contact with a downwardly and inwardly converging slide surface of a ring tool which surrounds the collet. In general, the corresponding slide surface of the ring tool is a one-part surface and does not comprise a plurality of single surfaces, each assigned to an outer surface of a collet finger.

Moreover, the slide surface of the ring tool generally has for each outer surface of the collet fingers the same inclination. It is of course feasible that there might be different inclinations or even no inclination of the corresponding side surface in particular parts in case the collet fingers have some elasticity or flexibility and in case the collet fingers are differently pressed into the receiving recess.

Moreover, to realize such pivoting or tilting movement of the collet in a simple way a lower end flange of the collet can be in contact with a downwardly and outwardly diverging contact surface of the ring tool. This means that the collet fingers are pivoted to the cup and the lower part of the collet is pivoted away from the cup or the supporting tool when the collet is moved relative to the ring tool for providing corresponding cam action.

It was already said that supporting tool and collet may be together slidably supported with respect to the ring tool in axial direction. This is for example realized by supporting tool and collet movably connected to each other. To allow a corresponding tilting or pivoting movement of the collet with respect to the supporting tool which might only be displaced in axial direction, the corresponding connection between supporting tool and collet may be an articulated joint or a corresponding hinge connection.

Mandrel and supporting tool are adapted to approach each other during pivoting of the collet from release position to pressing position. This approaching will result in a corresponding compression or reduction of height of the cup to avoid any stretching of the paper, see also our comments set forth above.

It was already said that the protrusion of the collet finger may be an outwardly and inwardly converging protrusion adapted to emboss the wall of the cup to form an inwardly protruding groove. This groove will be the initial line or part of the cup where the cup is deformed for forming the stacking projection.

According to another embodiment of the invention, it is also possible that collet and supporting tool are a one-part tool with the collet fingers upwardly extending from the support tool. In such a case the ring tool will be arranged outside of the supporting tool and will be surrounding same. When there is a relative movement of the supporting tool with respect to the ring tool, the collet fingers will be pressed to the inside by a corresponding cam action as already outlined above. However, in such a case there should be some flexible connection between the collet fingers and the supporting tool to allow such pivoting of the collet fingers with respect to the supporting tool.

In case the thickness of the paper material arranged between the lower surface of the mandrel and the upper support surface of the supporting tool is not considered, a corresponding gap between those surfaces in release position will be about 1 mm to 5 mm and preferably between 1.5 mm and 2.5 mm. In the pressing position this gap is then less than 0.5 mm and preferably 0 mm. However, as already outlined above for measuring this gap, the thickness of the paper material or the thickness of the bottom plate arranged between those surfaces is not considered. The corresponding values are examples and it is also possible that they are slightly bigger wherein in general a corresponding reduction in distance between the surfaces will be sufficient, which is about 1 mm to 3 mm.

A corresponding cup with the stacking projection may be used as a part of a double-walled cup or also for an embossed cup.

Generally, the material of such a cup is paper, cardboard or the like whereas other materials might additionally require the application of heat for deforming the cup wall to form such stacking projection.

BRIEF DESCRIPTION OF THE DRAWINGS

In the following, embodiments of the invention are illustrated in the Figures.

The following are shown.

DETAILED DESCRIPTION OF THE DRAWINGS

Figure 1:
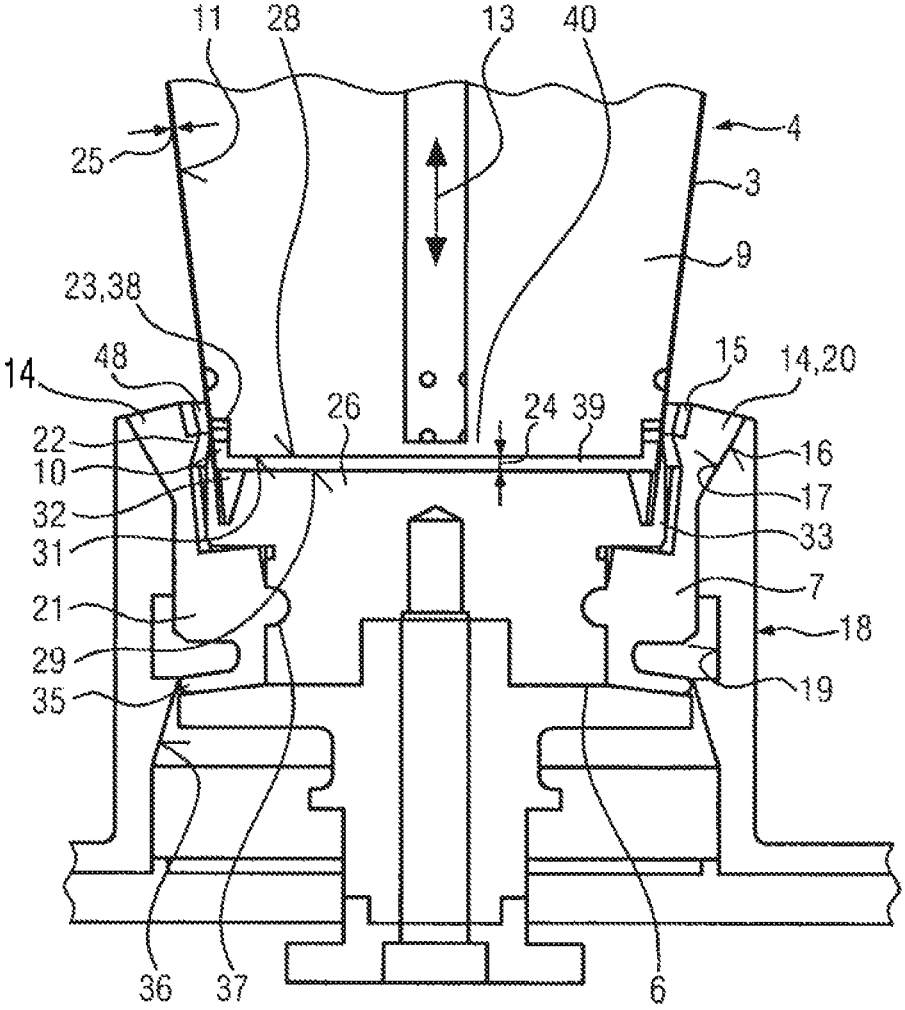
FIG. 1 a vertical sectional view of the tool according to the invention in an open position.

In FIG. 1, a vertical sectional view of tool 1 according to the present application is illustrated. Tool 1 comprises a mandrel 9 which is inserted in a cup 4 wherein a corresponding cup wall 3 is an abutment with an outer circumference 11 or corresponding outer surface 31 of the mandrel 9. For holding the cup 4 onto the mandrel 9, a number of low pressure lines 30 are used which end in this outer surface 31, see also FIGS. 2 and 4.

At a lower part of the mandrel 9, see its lower end 40, a receiving recess 10 is arranged, which is open to the outer circumference 11 and also in direction to a lower end surface 28. The mandrel is displaceable in axial directions 13 by a corresponding lifting and lowering mechanism, which is not explicitly illustrated in the Figures.

In FIG. 1, an open position of the tool is illustrated, which means that the mandrel 9 can be lifted or lowered to arrange the corresponding cup 4 and particular its bottom part 5 on a supporting tool 6. This supporting tool is arranged beneath the mandrel and comprises an upper support surface 29 directed to lower end surface 28 of the mandrel 9. In the open position according to FIG. 1, lower end surface 28 and upper support surface 29 are arranged in a distance 24 such that a gap 39 is formed between the two surfaces. Corresponding lower end surface 28 is also part of the outer surface 31 of the mandrel 9.

Figure 2:
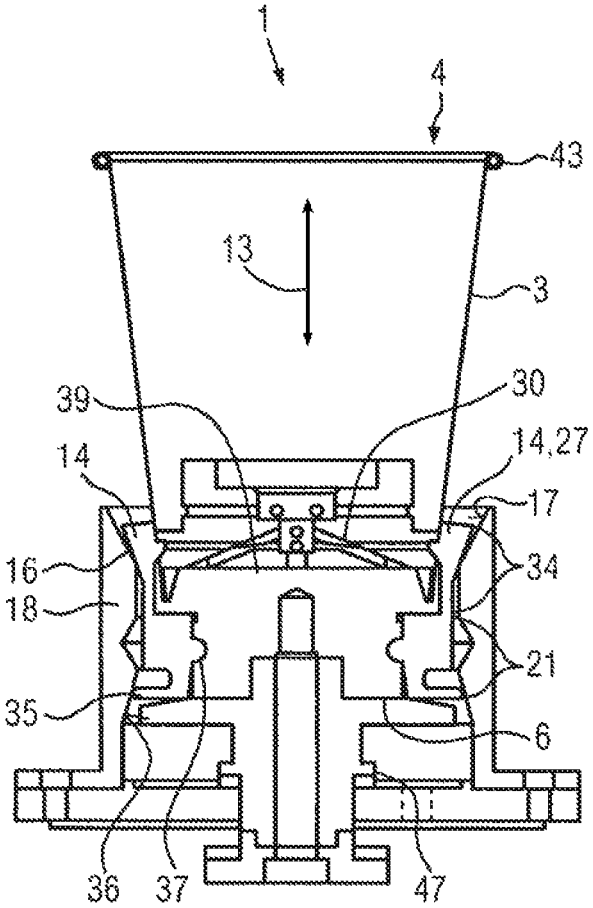
FIG. 2 a view similar to FIG. 1 in a closed position of the tool.

The supporting tool 6 is surrounded by a collet 7 which has a ring shape and further a plurality of collet fingers 14 in an upper end portion 34 of the collet, see also FIG. 2. Those collet fingers are separated by slots 15 and are arranged in particular in a region 8 of the cup 4 or mandrel 9 where the receiving recess 10 is arranged and where a stacking projection 2 should be formed, see also FIGS. 3 and 5.

In the position according to FIG. 1, the collet fingers 14 are arranged in their release position 20, which means they are only in contact with the wall 3 from its outside by corresponding step-like protrusions 22 which are radially extending from an inner surface of the corresponding collet fingers 14.

Outer surfaces 16 of corresponding collet fingers 14 opposite to corresponding inner surface are in contact with a slide surface 17 of a ring tool 18 surrounding the collet 7 and also the supporting tool 6. The ring tool 18 is a further part of tool 1 as well as the mandrel 9, the collet 7, and the supporting tool 6.

The corresponding slide surface 17 is upwardly and outwardly diverging, see FIGS. 1 and 2, wherein the corresponding outer surfaces 16 of the collet fingers 14 are in contact with this slide surface.

The slide surface 17 is part of an inner surface 19 of the ring tool 18 which also comprises a contact surface 36 which is assigned to an end flange 35 of the collet 7. This end flange 35 is arranged in a lower part 21 of the collet and radially extends outward. The contact surface 36 is outwardly and downwardly diverging.

Within the ring tool 18, collet 7 and supporting tool 6 are axially displaceable, see also support 47 in FIG. 2, which is fixed to the supporting tool 6 and is used for displacing same in axial direction 13. Furthermore, there is an articulated joint 37 or hinge mechanism arranged between collet 7 and supporting tool 6 such that the collet may pivot or tilt about this articulated joint 37 with respect to the supporting tool 6 and, correspondingly, also with respect to axial direction 13.

For example, in FIG. 2, the collet is tilted such that the collet fingers 14 are displaced more radially inwards wherein the end flange 37 is displaced more radially outwards in comparison to FIG. 1.

Figure 3:
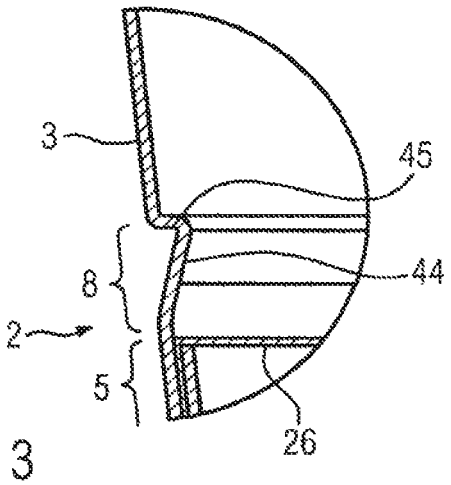
FIG. 3 an enlarged illustration of a part of the cup where the stacking projection is formed.

The corresponding step-like protrusion 22 extends upwardly and inwardly converging and is used for forming the corresponding stacking projection 2 or ledge, see also FIG. 3. The step-like protrusion 22 has a tip 48 which is already in contact with the wall 3 from its outside in the release position 20, see FIG. 1. When the cup 4 is lowered by mandrel 9 to arrange the bottom part 5 of the cup 4 and in particular bottom plate 26 on upper support surface 29 of supporting tool 6 corresponding tip 48 will produce a small embossment 23 in the wall 3 which embossment has the form of the groove 38 extending to the interior of the cup. This embossment or groove in particular an the initial starting point for forming the stacking projection 2.

The supporting tool 6 has further a groove 32 surrounding the upper support surface 29, wherein in this groove 32 a bottom edge 33 of the cup 4 is arranged, see FIGS. 1 and 2. This bottom edge 33 is also part of the bottom part 5 of the cup 4.

In FIG. 2 the tool 1 is illustrated in a closed position, which means that mandrel 9 and supporting tool 6 are lowered within the ring tool 18. With lowering the supporting tool 6 also collet 7 is moved in axial direction 13 such that the outer surfaces 16 of the collet fingers 14 slide along the slide surface 17 in a cam action according to which these collet fingers 14 are displaced in direction to the receiving recess 10 and corresponding end flange 35 is radially displaced in outward direction. Corresponding bottom edge 33 will follow the contact surface 36 such that the collet 7 in total will make a pivoting or tilting movement around the articulated joint 37, see in comparison FIGS. 1 and 2. By the corresponding camming action between the outer surfaces 16 and the slide surface 17, the step-like protrusions 22 are pressed in direction and into the receiving recess 10 to form the stacking projection 2. Simultaneously, corresponding distance 24 or a gap 39 between lower end surface 28 and upper support surface 29 is decreased and might be decreased such that the gap only has a width corresponding to a thickness 25 of the corresponding material of the cup wall and in particular of the bottom plate 26 of the cup.

In FIG. 2 the corresponding collet fingers 14 are in their pressing position 27 with the step-like protrusions 22 inserted into the receiving recess 10. As already outlined, by the simultaneous reduction of the gap 39 there is some kind of compression of the cup 4 in the area of the bottom part 5 which compression will prevent any stretching of the paper or the wall material during deforming by the step-like protrusions. This means, together with the inward movement of the collet fingers a corresponding height 12 of the cup 4 is reduced by such compression or lifting of the bottom plate 26 and also bottom part 5 which is just sufficient to allow the paper to fold and to form the stacking projection without stretching the paper. Consequently, there will be no thinning of, for example, an inner layer of polymer of the cup wall and also pinholes will not be formed which might cause leakage. Moreover, as the paper is not stretched, it also does not loose some of its mechanical strength and does not become weaker.

According to one embodiment of the invention it is possible that the corresponding gap 39 is reduced by 1 mm to 3 mm between the two positions illustrated in FIGS. 1 and 2, wherein the gap might also be reduced by 1.5 mm to 2.5 mm and preferably by 2 mm.

It is not necessary according to present invention, see for example FIG. 2, that the lower end surface 28 and upper support surface 29 are in contact with respect to each other with only the bottom plate 26 arranged therebetween. It is also possible that the corresponding gap 39 according to FIG. 1 is still present, but is, of course reduced in height by the corresponding amount.

In FIG. 3 the particular section of the cup 4 where the stacking projection is formed, is illustrated in an enlarged form. The corresponding stacking projection 2 comprises a side wall 44 inwardly and upwardly converging wherein to the upper end of the side wall 44 an essentially horizontal top wall 45 is connected. Corresponding stacking projection 2 is formed in the region 8, see also the assignment of the collet fingers 14 and in particular of the step-like protrusion 22 to this region in FIGS. 1 and 2.

According to the embodiment illustrated in FIG. 3 the corresponding stacking projection 2 is arranged directly above the bottom part 5 and in particular the bottom plate 26. Such stacking projection 2 is used for nesting cups into each other, see FIG. 5 with two cups. The inner cup 4 is supported by the top wall 45 of the stacking projection 2 wherein a corresponding inward curl 41 at a lower end of an overwrap 42 of corresponding double-walled cup 4 is supported by the top wall 45. This supporting will prevent any sticking of the cups such that it is possible to easily remove the inner cup 4 from the outer cup. Corresponding overwrap 42 extends up to an outward curl 43 at the upper end of the cup 4. Between overwrap 42 and cup wall 3 an insulating gap is formed.

Figure 4:
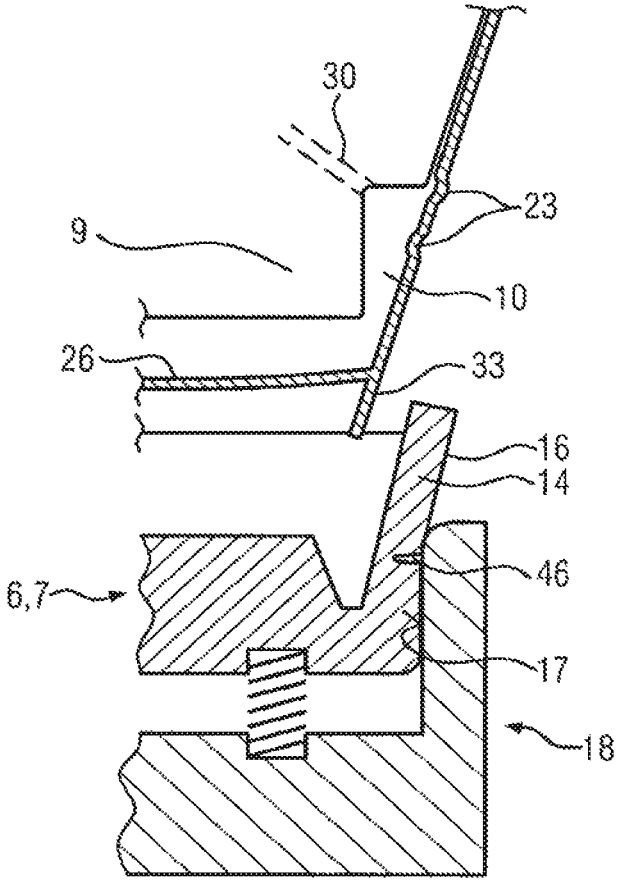
FIG. 4 a further embodiment of the tool in an open position.

In FIG. 4 a second embodiment of a corresponding tool 1 is illustrated. According to this embodiment, there is a one-part supporting tool 6 and collet 7. This means, that corresponding collet fingers 14 extend upwardly from an upper end of the supporting tool 6, wherein the supporting fingers 14 have some elasticity or flexibility such that they may be bended inwardly in case the supporting tool with the collet fingers is lowered within ring tool 18. The ring tool 18 according to this embodiment has a vertical slide surface 17, wherein outer surfaces 16 of the collet fingers 14 are upwardly and outwardly diverging. This means, by lowering the supporting tool 6 within the ring tool 18 the collet fingers 14 will be pressed radially inwards by the corresponding contact with the slide surface 17. To improve corresponding elasticity/flexibility, a slot 46 may be arranged, see FIG. 4.

The mandrel 9 according to FIG. 4 may be of the same construction as in FIGS. 1 and 2 and also comprises for example a low pressure line 30 for holding the cup onto the mandrel.

According to the second embodiment it may be advantageous, in case there are two embossments 23 formed in the cup wall prior to bending this part of the cup wall in direction to a corresponding receiving recess 10 by pressing action of inwardly deflected collet fingers 14.

The two embossments 23 are arranged in a distance from each other and in general at upper and lower ends of the stacking projection 2.

The upper embossment 23 according to FIG. 4 may extend to the outside and the lower embossment to the inside. It is, however, also possible that both are directed to the inside, both are directed to the outside or the upper to the inside and the lower to the outside. Corresponding embossments are pre-embossed prior to arranging the cup within the supporting tool 6 and will simplify any bending of the cup wall to form the stacking projection.

Such pre-embossment is not necessary according to the first embodiment of this invention, see FIGS. 1 and 2.

It is again emphasized, that according to the present invention there is a simultaneous action of forming the stacking projection by tilting or pivoting the collet fingers 14 to the inside and compressing the cup in particular in the area of the bottom part and where the stacking projection 2 is formed. By this simultaneous action any stretching of the material of the material of the wall is prevented.

Figure 5:
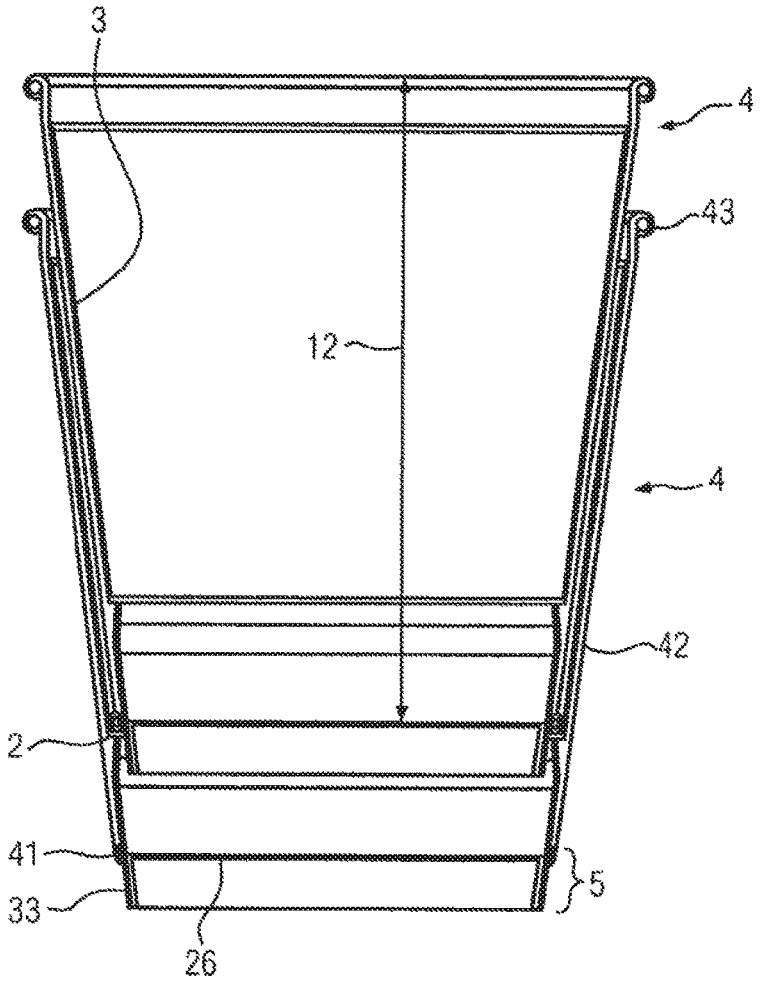
FIG. 5 a vertical sectional view of two stacked cups.

FIG. 5 is a vertical section through two cups stacked in each other to illustrate the nesting or stacking according to the contact of the inward curl 41 with the stacking projection 2, see also the comments set forth above.

The invention claimed is:

1. Method of producing a stacking projection inwardly protruding from a wall of a cup comprising:

i) inserting a mandrel within the cup, which mandrel comprises a receiving recess at least open to the outer circumference of the mandrel, ii) supporting a bottom part of the cup by a supporting tool;

iii) assigning a collet to a region of the cup wall where the stacking projection is to be formed;

iv) pressing at least a part of the collet radially inwardly in direction to the receiving recess wherein a portion of the cup wall is pressed into the receiving recess to form said stacking projection;

v) simultaneously to step iv) reducing the height of the cup by displacing the mandrel and/or the supporting too with respect to the other in axial direction, and vi) releasing pressure applied to the collet and removing the cup with the mandrel from the collet and the supporting tool and (vii) wherein in step iv) a plurality of collet fingers separated from each other by a slot there between are pressed radially inward.

2. Method according to claim 1, wherein in step iv) the collet with its collet fingers is axially displaced to enable- an outer surface of each collet finger to slides along an inwardly and downwardly converging slide surface of a ring tool surrounding at least the collet.

3. Method according to claim 2, wherein the supporting tool and the mandrel are axially displaced together with the collet.

4. Method according to claim 2, which comprises supporting the collet and its collet fingers by an inner surface of the ring tool in a release position of the collet and tilting the collet fingers radially inwardly and a lower part of the collet beneath the collet fingers radially outwardly to obtain a pivoting movement of the collet.

5. Method according to claim 2, which comprises axially moving the collet fingers with respect to the ring tool by retraction of the support tool with respect to the ring tool in axial direction, wherein the collet is moved together with the supporting tool.

6. Method according to claim 5, which comprises pressing, prior to steps iv), the cup wall against a step-like protrusion of each collet finger to form a particular ring-shaped embossment radially inwardly protruding from the cup wall into the receiving recess.

7. Method according to claim 6, which comprises arranging during steps iv) and v) the mandrel and the support tool in a first distance to each other bigger than a thickness of the material of a bottom plate of the cup arranged there between and reducing this first distance during steps iv) and v).

8. Method according to claim 7, which comprises after step vi), arranging an overwrap onto the cup wall and fixing the overwrap to the cup wall at least in positions above and below the stacking projection.

9. Method according to claim 1, which comprises holding the cup onto the mandrel after forming of the stacking projection and removing the cup with the mandrel from the collet and the supporting tool.

10. Method according to claim 1 wherein in step iv) the collet with its collet fingers is axially displaced such that an outer surface of each collet finger slides along an inwardly and downwardly converging slide surface of a ring tool surrounding at least the collet.

11. Method of producing a stacking projection inwardly protruding from a wall of a cup comprising:

i) inserting a mandrel within the cup, which mandrel comprises a receiving recess at least open to the outer circumference of the mandrel, ii) supporting a bottom part of the cup by a supporting tool;

iii) assigning a collet to a region of the cup wall where the stacking projection is to be formed;

iv) pressing at least a part of the collet radially inwardly in direction to the receiving recess such that a portion of the cup wall is pressed into the receiving recess to form said stacking projection;

v) simultaneously to step iv) reducing the height of the cup by displacing the mandrel and/or the supporting too with respect to the other in axial direction, and vi) releasing pressure applied to the collet and removing the cup with the mandrel from the collet and the supporting tool and wherein in step iv) a plurality of collet fingers are radially inwardly pressed which collet fingers are all separated from each other by a slot there between.

12. The method of claim 11 wherein in step iv) the collet with its collet fingers is axially displaced wherein an outer surface of each collet finger slides along an inwardly and downwardly converging slide surface of a ring tool surrounding at least the collet, the supporting tool and the mandrel are axially displaced together with the collet and wherein the collet and its collet fingers are supported by an inner surface of the ring tool in a release position of the collet and tilting the collet fingers radially inwardly and a lower part of the collet beneath the collet fingers radially outwardly to obtain a pivoting movement of the collet.

13. Method according to claim 11 wherein in step iv) the collet with its collet fingers is axially displaced wherein an outer surface of each collet finger slides along an inwardly and downwardly converging slide surface of a ring tool surrounding at least the collet.

* * * * *